US011538312B2

(12) United States Patent
Peters et al.

(10) Patent No.: US 11,538,312 B2
(45) **Date of Patent: *Dec. 27, 2022**

(54) SYSTEM AND METHOD FOR PROVIDING A GAME WITH WARPING SYMBOLS

(71) Applicant: Video Gaming Technologies, Inc., Franklin, TN (US)

(72) Inventors: Brian Peters, Reno, NV (US); Zachary Thomas Schmid, Sparks, NV (US); Craig Ronald Kelly, Reno, NV (US); Brandon Mason, Reno, NV (US); Edgar Portigal, Reno, NV (US)

(73) Assignee: Video Gaming Technologies, Inc., Franklin, TN (US)

( * ) Notice: Subject to any disclaimer, the term of this patent is extended or adjusted under 35 U.S.C. 154(b) by 287 days.

This patent is subject to a terminal disclaimer.

(21) Appl. No.: 16/886,194

(22) Filed: May 28, 2020

(65) Prior Publication Data

US 2020/0294368 A1 Sep. 17, 2020

Related U.S. Application Data

(63) Continuation of application No. 14/498,269, filed on Sep. 26, 2014, now Pat. No. 10,672,232.

(51) Int. Cl.
*G07F 17/34* (2006.01)
*G07F 17/32* (2006.01)

(52) U.S. Cl.
CPC ..... *G07F 17/34* (2013.01); *G07F 17/326* (2013.01)

(58) Field of Classification Search
CPC ..... G07F 17/34; G07F 17/326
See application file for complete search history.

(56) References Cited

U.S. PATENT DOCUMENTS

| | | | |
|---|---|---|---|
| 5,980,384 | A | 11/1999 | Barrie |
| 6,270,412 | B1 | 8/2001 | Crawford |
| 8,002,625 | B2 | 8/2011 | Maya |
| 8,162,741 | B2 | 4/2012 | Wadleigh |
| 8,388,435 | B2 | 3/2013 | Anderson |

(Continued)

OTHER PUBLICATIONS

Request for Recalculation of Patent Term Adjustment in View of AIA Technical Corrections Act of U.S. Pat. No. 8,388,435 dated Jul. 30, 2014; 74 pages.

(Continued)

*Primary Examiner* — Tramar Harper
*Assistant Examiner* — Jeffrey K Wong
(74) *Attorney, Agent, or Firm* — Armstrong Teasdale LLP

(57) ABSTRACT

A gaming machine identifies a first pattern within a first play area including a plurality of first positions arranged in a plurality of first columns, determines whether the first pattern satisfies a predetermined first threshold based on a first position and a first symbol, identifies a second position associated with the first symbol in a second play area including a plurality of second positions arranged in a plurality of second columns, and associates the second position with a second symbol. Each first position is associated with a respective symbol of a plurality of symbols including the first symbol and the second symbol. The first pattern is associated with the first position. The first position is associated with the first symbol. Each second position is associated with a respective symbol of the plurality of symbols.

20 Claims, 9 Drawing Sheets

| | | | | |
|---|---|---|---|---|
| K | A | 10 | 10 | K |
| J | K | 10 | J | J |
| A | J | K | 10 | A |

| | | | | |
|---|---|---|---|---|
| K | A | K | 10 | J |
| K | A | K | 10 | J |
| K | A | 10 | 10 | J |
| K | 10 | 10 | J | J |
| K | 10 | 10 | J | J |
| J | 10 | 10 | J | J |
| J | J | 10 | J | K |
| J | J | 10 | J | K |
| J | J | 10 | A | K |
| J | J | 10 | A | K |
| J | J | 10 | K | K |
| A | A | A | K | K |

(56) References Cited

U.S. PATENT DOCUMENTS

| | | | | |
|---|---|---|---|---|
| 8,602,871 | B2 | 12/2013 | Wadleigh | |
| 2008/0064487 | A1* | 3/2008 | Stevens | G07F 17/34 463/31 |
| 2013/0157741 | A1 | 6/2013 | Pacey | |
| 2014/0080572 | A1 | 3/2014 | Watkins | |
| 2014/0094265 | A1 | 4/2014 | Aoki | |
| 2014/0274295 | A1 | 9/2014 | Poole | |

OTHER PUBLICATIONS

Notice of Abandonment of U.S. Appl. No. 11/749,018 dated May 12, 2011; 17 pages.

* cited by examiner

| | | | | |
|---|---|---|---|---|
| K | A | 10 | 10 | K |
| J | K | 10 | J | J |
| A | J | K | 10 | A |

| | | | | |
|---|---|---|---|---|
| K | A | K | 10 | J |
| K | A | K | 10 | J |
| K | A | 10 | 10 | J |
| K | 10 | 10 | J | J |
| K | 10 | 10 | J | J |
| J | 10 | 10 | J | J |
| J | J | 10 | J | K |
| J | J | 10 | J | K |
| J | J | 10 | A | K |
| J | J | 10 | A | K |
| J | J | 10 | K | K |
| A | A | A | K | K |

FIG. 7

| | | | | |
|---|---|---|---|---|
| K | A | 10 | 10 | K |
| J | K | 10 | J | J |
| A | J | K | 10 | A |

FIG. 8

| | | | | |
|---|---|---|---|---|
| K | A | K | 10 | J |
| K | A | K | 10 | J |
| K | A | 10 | 10 | J |
| K | 10 | 10 | J | J |
| K | 10 | 10 | J | J |
| J | 10 | 10 | J | J |
| J | J | 10 | J | K |
| J | J | 10 | J | K |
| J | J | 10 | A | K |
| J | J | 10 | A | K |
| J | J | 10 | K | K |
| A | A | A | K | K |

FIG. 9

| | | | | |
|---|---|---|---|---|
| W | A | W | 10 | J |
| W | A | W | 10 | J |
| W | A | 10 | 10 | J |
| W | 10 | 10 | J | J |
| W | 10 | 10 | J | J |
| J | 10 | 10 | J | J |
| J | J | 10 | J | W |
| J | J | 10 | J | W |
| J | J | 10 | A | W |
| J | J | 10 | A | W |
| J | J | 10 | W | W |
| A | A | A | W | W |

FIG. 10

SYSTEM AND METHOD FOR PROVIDING A GAME WITH WARPING SYMBOLS

CROSS REFERENCE TO RELATED APPLICATIONS

This application is a continuation of U.S. patent application Ser. No. 14/498,269, filed Sep. 26, 2014, entitled "SYSTEM AND METHOD FOR PROVIDING A GAME WITH WARPING SYMBOLS," which is hereby incorporated by reference in its entirety.

BACKGROUND

The field of the disclosure relates generally to gaming systems, and, more particularly, to methods and systems for providing a game of chance with warping symbols.

Conventionally, gaming machines provide games wherein a player has one or more opportunities to obtain a winning symbol combination on mechanical or video reels. At least some known games have a predetermined number of winning symbol combinations based on a predetermined set of symbols.

BRIEF SUMMARY

In one aspect, a method is provided for presenting a game of chance on a gaming machine. The method includes identifying at least one first pattern within a first play area including a plurality of first positions arranged in a plurality of first columns, determining whether the at least one first pattern satisfies a predetermined first threshold based on at least one first position and a first symbol, identifying at least one second position associated with the first symbol in a second play area including a plurality of second positions arranged in a plurality of second columns, and associating the at least one second position with a second symbol. Each first position of the plurality of first positions is associated with a respective symbol of a plurality of symbols including the first symbol and the second symbol. The at least one first pattern is associated with the at least one first position. The at least one first position is associated with the first symbol of the plurality of symbols. Each second position of the plurality of second positions is associated with a respective symbol of the plurality of symbols.

In yet another aspect, one or more computer-readable storage media having computer-executable instructions embodied thereon is provided. When executed by at least one processor, the computer-executable instructions cause the at least one processor to identify at least one first pattern within a first play area including a plurality of first positions arranged in a plurality of first columns, determine whether the at least one first pattern satisfies a predetermined first threshold based on at least one first position and a first symbol, identify at least one second position associated with the first symbol in a second play area including a plurality of second positions arranged in a plurality of second columns, and associate the at least one second position with a second symbol. Each first position of the plurality of first positions is associated with a respective symbol of a plurality of symbols including the first symbol and the second symbol. The at least one first pattern is associated with the at least one first position. The at least one first position is associated with the first symbol of the plurality of symbols. Each second position of the plurality of second positions is associated with a respective symbol of the plurality of symbols.

In yet another aspect, a gaming machine is provided. The gaming machine includes a frame, and a computing device coupled to the frame. The computing device includes at least one processor, and one or more computer-readable storage media having computer-executable instructions embodied thereon. When executed by the at least one processor, the computer-executable instructions cause the at least one processor to identify at least one first pattern within a first play area including a plurality of first positions arranged in a plurality of first columns, determine whether the at least one first pattern satisfies a predetermined first threshold based on at least one first position and a first symbol, identify at least one second position associated with the first symbol in a second play area including a plurality of second positions arranged in a plurality of second columns, and associate the at least one second position with a second symbol. Each first position of the plurality of first positions is associated with a respective symbol of a plurality of symbols including the first symbol and the second symbol. The at least one first pattern is associated with the at least one first position. The at least one first position is associated with the first symbol of the plurality of symbols. Each second position of the plurality of second positions is associated with a respective symbol of the plurality of symbols.

The features, functions, and advantages described herein may be achieved independently in various embodiments of the present disclosure or may be combined in yet other embodiments, further details of which may be seen with reference to the following description and drawings.

BRIEF DESCRIPTION OF THE DRAWINGS

FIGS. 1-10 show example embodiments of the method and system described herein.

FIG. 1 is a schematic diagram of an example gaming machine;

FIG. 2 is a schematic block diagram of an example gaming network including a plurality of the gaming machines shown in FIG. 1;

FIG. 3 is a schematic block diagram of an example computing device that may be used with the gaming machine shown in FIG. 1;

FIG. 4 includes example schematic illustrations of a plurality of first patterns within a first play area;

FIG. 5 includes example schematic illustrations of a plurality of second patterns within a second play area;

FIG. 6 is a flowchart of an example method for presenting a game of chance using the computing device shown in FIG. 3;

FIGS. 7-10 are example schematic illustrations of the game of chance at various stages of the method shown in FIG. 4.

Figure 1:
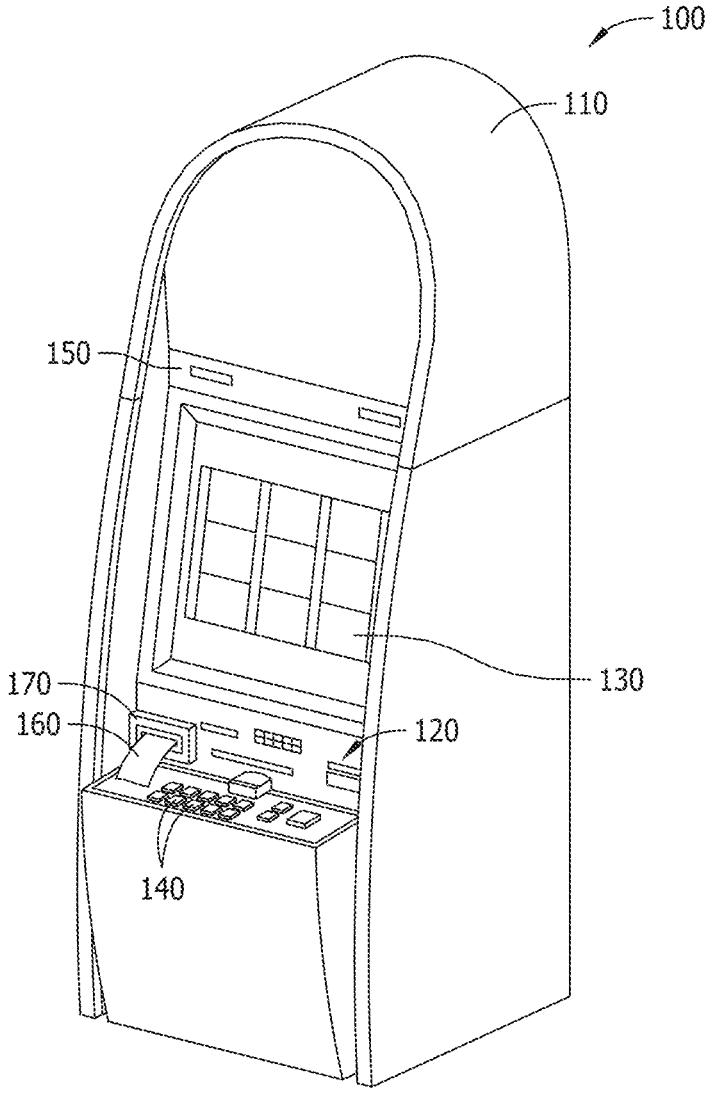

Although specific features of various embodiments may be shown in some drawings and not in others, such illustrations are for convenience only. Any feature of a drawing may be referenced and/or claimed in combination with any feature of any other drawing. Corresponding reference characters indicate corresponding parts throughout the several views of the drawings.

DETAILED DESCRIPTION

Example embodiments of systems and methods for use in providing a game of chance with warping symbols are described herein. As used herein, the term "warp" refers to the association or reassociation of a position with a particular symbol, such as replacing a first symbol for a second symbol or supplementing a first symbol with a second symbol. In one embodiment, a gaming machine identifies a first pattern within a first play area, determines whether the first pattern satisfies a predetermined first threshold based on a first position and a first symbol, identifies a second position associated with the first symbol in a second play area, and associates the second position with a second (e.g., wild) symbol. By warping the first symbol into a wild symbol, for example, the systems and methods described herein facilitate increasing a probability of winning symbol combinations.

The methods and systems described herein may be implemented using computer programming or engineering techniques including computer software, firmware, hardware, or any combination or subset thereof, wherein the technical effects may be achieved by performing at least one of the following steps: (a) receiving a play input; (b) determining a number of first patterns based on the play input; (c) identifying at least one first pattern within a first play area; (d) associating the at least one first pattern with a first position in each first column of the plurality of first columns; (e) determining whether the at least one first pattern satisfies a predetermined first threshold; (f) identifying at least a subset of first positions associated with the first symbol in the set of first positions; (g) identifying at least one second position associated with the first symbol in a second play area; (h) associating the at least one second position with a second symbol; (i) determining a number of second patterns based on the play input; (j) identifying at least one second pattern within the second play area; and (k) determining whether the at least one second pattern satisfies a predetermined second threshold.

The following detailed description illustrates embodiments of the disclosure by way of example and not by way of limitation. It is contemplated that the disclosure has application to gaming methods and systems, in general, to facilitate increasing a probability of winning symbol combinations.

An element or step recited in the singular and preceded with the word "a" or "an" should be understood as not excluding plural elements or steps unless such exclusion is explicitly recited. Moreover, references to an "example embodiment" or "one embodiment" are not intended to be interpreted as excluding the existence of additional embodiments that also incorporate the recited features.

FIG. 1 is a schematic diagram of an example gaming machine 100 including a cabinet or frame 110, and a gaming controller 120 coupled to frame 110. In the example embodiment, frame 110 is configured to house a plurality of components, such as gaming controller 120, peripheral devices, presentation devices, and player interaction devices. For example, in the example embodiment, gaming machine 100 includes a plurality of input devices, such as a touch screen (e.g., presentation device 130) and switches and/or buttons 140 that are coupled to a front 150 of frame 110.

In the example embodiment, presentation device 130 is used to display one or more game images, symbols, and/or indicia such as a visual representation or exhibition of movement of an object (e.g., a mechanical, virtual, or video reel), dynamic lighting, video images, and the like. Presentation device 130 may include, without limitation, a plasma display, a liquid crystal display (LCD), a display based on light emitting diodes (LEDs), organic light emitting diodes (OLEDs), polymer light emitting diodes (PLEDs), and/or surface-conduction electron emitters (SEDs), a speaker, an alarm, and/or any other device capable of presenting information to a user. For example, in the example embodiment, presentation device 130 is a touch screen device. In an alternative embodiment, presentation device 130 displays images and indicia using mechanical means. For example, presentation device 130 may include an electromechanical device, such as one or more rotatable reels, to display a plurality of game or other suitable images, symbols, or indicia.

Buttons 140 may include a "Bet One" button that enables the player to place a bet or to increase a bet, a "Bet Max" button that enables the player to bet a maximum permitted wager, a "Cash Out" button that enables the player to receive a cash payment or other suitable form of payment such as a ticket or voucher 160, which corresponds to a number of remaining credits, and/or a "Spin" button that enables rotation of physical or simulated reels of the slot machine.

In the example embodiment, gaming machine 100 includes an input/output (I/O) device 170 coupled to front 150 for accepting and/or validating cash bills, coupons, tickets and/or vouchers 160. I/O device 170 may also be capable of printing coupons, tickets and/or vouchers 160. Furthermore, in some embodiments, I/O device 170 includes a card reader or validator for use with credit cards, debit cards, identification cards, and/or smart cards. The cards accepted by I/O device 170 may include a magnetic strip and/or a preprogrammed microchip that includes a player's identification, credit totals, and any other relevant information that may be used.

In the example embodiment, gaming controller 120 is programmed to control and/or determine at least some functions and/or operations associated with gaming machine 100. For example, in one embodiment, gaming controller 120 is configured to generate at least one gaming event. "Gaming event" may refer to one or more events associated with gaming controller 120 including, without limitation, a game start, a win, a loss, a number of consecutive wins, a number of consecutive losses, a number of credits awarded, a number of credits lost, a close win, and a close loss.

In one embodiment, gaming controller 120 randomly generates game outcomes using probability data. For example, each game outcome is associated with one or more probability values that are used by gaming controller 120 to determine the game output to be displayed. Such a random calculation may be provided by a random number generator, such as a true random number generator (RNG), a pseudo-random number generator (PNG), or any other suitable randomization process. Gaming controller 120 may be any type of gaming machine, and may include, without limitation, different structures than those shown in FIG. 1. Moreover, gaming controller 120 may employ different methods of operation than those described below.

Figure 2:
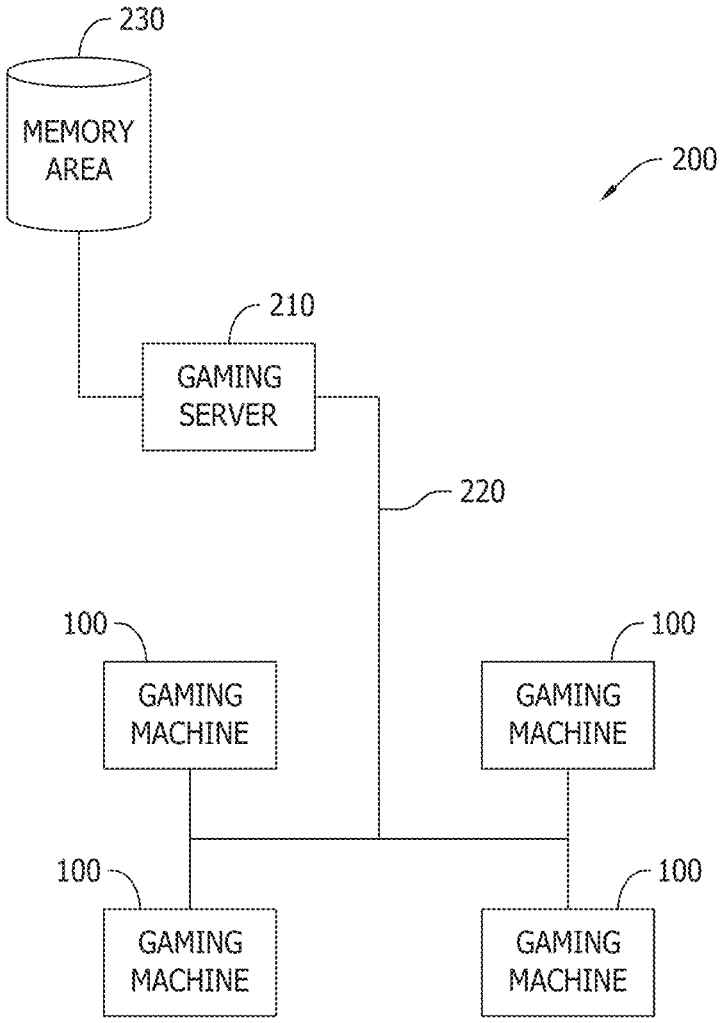

FIG. 2 is a schematic block diagram of an example gaming network 200 that includes a plurality of gaming machines 100 coupled to one or more gaming servers 210 via a communication network 220. Gaming server 210 includes a processor (not shown) that facilitates data communication between each gaming machine 100 and other components of gaming network 200. Such data is stored in, for example, a memory area 230, such as a database or a file system, which is coupled to gaming server 210.

In one embodiment, one or more gaming machines 100 may be remote gaming machines that access a casino over communication network 220. As such, a player is able to participate in a game of chance on a remote gaming machine while a player proxy is physically present at, for example, a casino or some other location. It will be understood that a player operating a remote gaming machine has virtual access to any casino coupled to communication network 220 and associated with gaming server 210. Further, while gaming machines 100 are described herein as video bingo machines, video poker machines, video slot machines, and/or other similar gaming machines that implement alternative games, gaming machines 100 may also be a personal computers coupled to the Internet or to a virtual private network such that a player may participate in a game of chance remotely. In other embodiments, the player may use a cell phone or other web enabled devices coupled to a communication network to establish a connection with a particular casino. Moreover, gaming machines 100 may be terminal-based machines, wherein the actual games, including random number generation and/or outcome determination, are performed at gaming server 210. In such an embodiment, gaming machines 100 display results of a game via presentation device 130 (shown in FIG. 1).

In one embodiment, gaming server 210 performs a plurality of functions including, for example, game outcome generation, executing a game play event for a player, player proxy selection, player tracking functions, and/or accounting functions, and data authentication functions, to name a few. However, in alternative embodiments, gaming network 200 may include a plurality of servers that separately perform these functions and/or any suitable function for use in a network-based gaming system.

Figure 3:
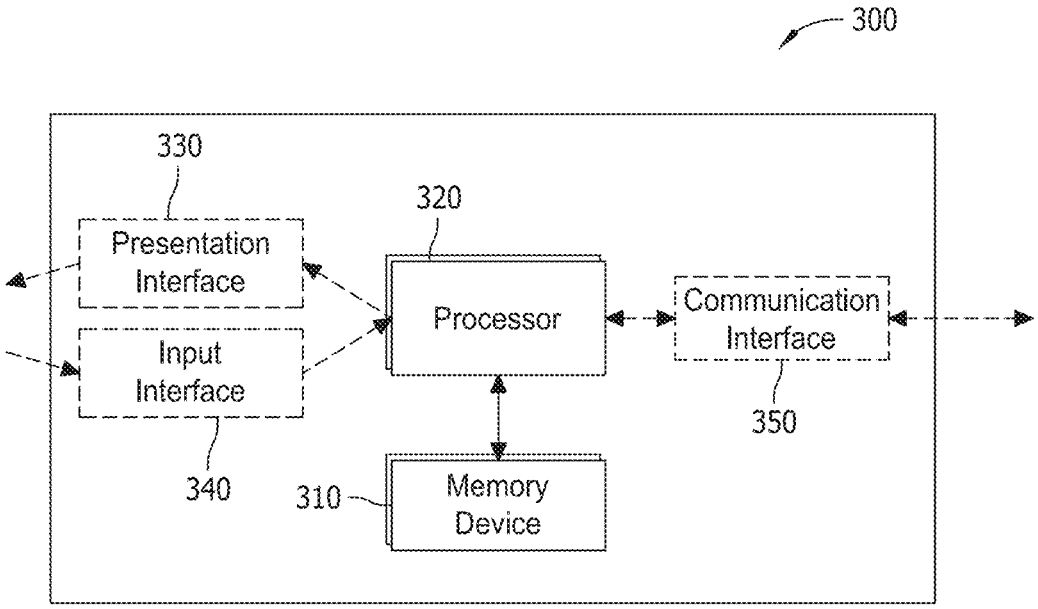

FIG. 3 is a schematic block diagram of a computing device 300, such as gaming controller 120 and/or gaming server 210. In the example embodiment, computing device 300 includes a memory device 310 and a processor 320 coupled to memory device 310 for use in executing instructions. More specifically, in the example embodiment, computing device 300 is configurable to perform one or more operations described herein by programming memory device 310 and/or processor 320. For example, processor 320 may be programmed by encoding an operation as one or more executable instructions and by providing the executable instructions in memory device 310.

Processor 320 may include one or more processing units (e.g., in a multi-core configuration). As used herein, the term "processor" is not limited to integrated circuits referred to in the art as a computer, but rather broadly refers to a controller, a microcontroller, a microcomputer, a programmable logic controller (PLC), an application specific integrated circuit, and other programmable circuits.

In the example embodiment, memory device 310 includes one or more devices (not shown) that enable information such as executable instructions and/or other data to be selectively stored and retrieved. In the example embodiment, such data may include, but is not limited to, gaming information, operational data, and/or control algorithms. In the example embodiment, computing device 300 is configured to interact with the player of gaming controller 120. Alternatively, computing device 300 may use any algorithm and/or method that enable the methods and systems to function as described herein. Memory device 310 may also include one or more computer readable media, such as, without limitation, dynamic random access memory (DRAM), static random access memory (SRAM), a solid state disk, and/or a hard disk.

In the example embodiment, computing device 300 includes a presentation interface 330 that is coupled to processor 320 for use in presenting information to a user. For example, presentation interface 330 may include a display adapter (not shown) that may couple to a display device (not shown), such as, without limitation, a cathode ray tube (CRT), a liquid crystal display (LCD), a light-emitting diode (LED) display, an organic LED (OLED) display, an "electronic ink" display, and/or a printer. In some embodiments, presentation interface 330 includes one or more display devices.

Computing device 300, in the example embodiment, includes an input interface 340 for receiving input from the user. For example, in the example embodiment, input interface 340 receives information suitable for use with the methods described herein. Input interface 340 is coupled to processor 320 and may include, for example, a joystick, a keyboard, a pointing device, a mouse, a stylus, a touch sensitive panel (e.g., a touch pad or a touch screen), and/or a position detector. It should be noted that a single component, for example, a touch screen, may function as both presentation interface 330 and as input interface 340.

In the example embodiment, computing device 300 includes a communication interface 350 that is coupled to processor 320. In the example embodiment, communication interface 350 communicates with at least one remote device, such as another computing device 300. For example, communication interface 350 may use, without limitation, a wired network adapter, a wireless network adapter, and/or a mobile telecommunications adapter. A network (not shown) used to couple computing device 300 to the remote device may include, without limitation, the Internet, a local area network (LAN), a wide area network (WAN), a wireless LAN (WLAN), a mesh network, and/or a virtual private network (VPN) or other suitable communication means.

Figure 4:
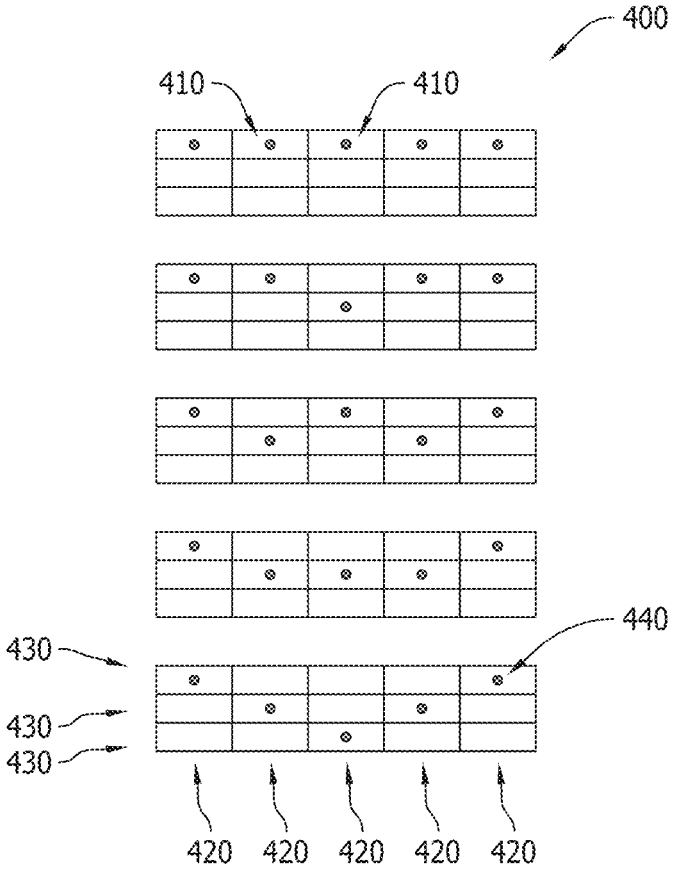

FIG. 4 shows schematic illustrations of a plurality of first play areas 400. As used herein, the terms "play area" is used to generally describe the positions of the one or more reels that are exposed or displayed to the player. In the example embodiment, each first play area 400 is a matrix including a plurality of first positions 410 arranged in a plurality of columns 420 and/or a plurality of rows 430. Although the illustrated first play areas 400 include five columns 420 and three rows 430, first play area 400 may have any configuration that that enables gaming machine 100 to function as described herein.

In the example embodiment, each column 420 represents and/or is associated with a reel. In the example embodiment, the reels are virtual. That is, in the example embodiment, the reels are generated by gaming machine 100 in memory prior to and/or during game play. Each first position 410 is associated with a respective symbol and may be modified or overwritten by gaming machine 100 during the course of gameplay. In this example, the game of chance uses a predetermined first set of symbols ("first symbol set") to populate first positions 410: "A", "K", "Q", "J", and "10". In the example embodiment, the first symbol set does not include a "wild" symbol, described in more detail below. Alternatively, the first symbol set includes a wild symbol. It should be understood that the symbols used in this example symbol set are chosen merely for purposes of discussion.

In the example embodiment, first play area 400 includes at least one first "payline" or pattern 440 including at least one first position 410. For example, in the example embodiment, each first pattern 440 includes a single (i.e., one and only one) first position 410 from each column 420. Moreover, in the example embodiment, first positions 410 within each first pattern 440 are serially connected (i.e., each first position 410 within first pattern 440 is in the same row 430 as a first position 410 within first pattern 440 in an adjacent column 420 or is in a row 430 immediately above or immediately below first position 410 within first pattern 440 in adjacent column 420). Alternatively, first pattern 440 may include any arrangement and/or combination of first patterns 440 that enable gaming machine 100 to function as described herein.

In the example embodiment, first pattern 440 satisfies a predetermined threshold (i.e., is a "winning" pattern) when first positions 410 within first pattern 440 are associated with symbols that satisfy a predetermined combination and/or arrangement of first positions 410 and/or symbols associated with first positions 410. For example, in the example embodiment, first pattern 440 is a winning pattern when a predetermined number (e.g., three) of first positions 410 within first pattern 440 are associated with a common symbol. In some embodiments, first pattern 440 is a winning pattern when a predetermined number (e.g., three) of serially-connected first positions 410 within first pattern 440 are associated with a common symbol. In at least some embodiments, first pattern 440 is a winning pattern when a predetermined number (e.g., three) of serially-connected first positions 410 within first pattern 440 are associated with a common symbol and one of the serially-connected first positions 410 is a first position 410 in the first (i.e., leftmost) column 420. Alternatively, any combination and/or arrangement first positions 410 and/or symbols associated with first positions 410 may satisfy the predetermined threshold that enables gaming machine 100 to function as described herein.

In some embodiments, first pattern 440 is a minor winning pattern when first pattern 440 satisfies a first predetermined threshold, and first pattern 440 is a major winning pattern when first pattern 440 satisfies a second predetermined threshold that is more difficult to satisfy than the first predetermined threshold. For example, in the example embodiment, first pattern 440 is a minor winning pattern when a first predetermined number (e.g., three) of first positions 410 within first pattern 440 are associated with a common symbol, and first pattern 440 is a major winning pattern when a second predetermined number (e.g., five) of first positions 410 within first pattern 440 are associated with a common symbol. Alternatively, any winning pattern may be associated with any combination and/or arrangement of first positions 410 and symbols associated with first positions 410 that enable gaming machine 100 to function as described herein.

Figure 5:
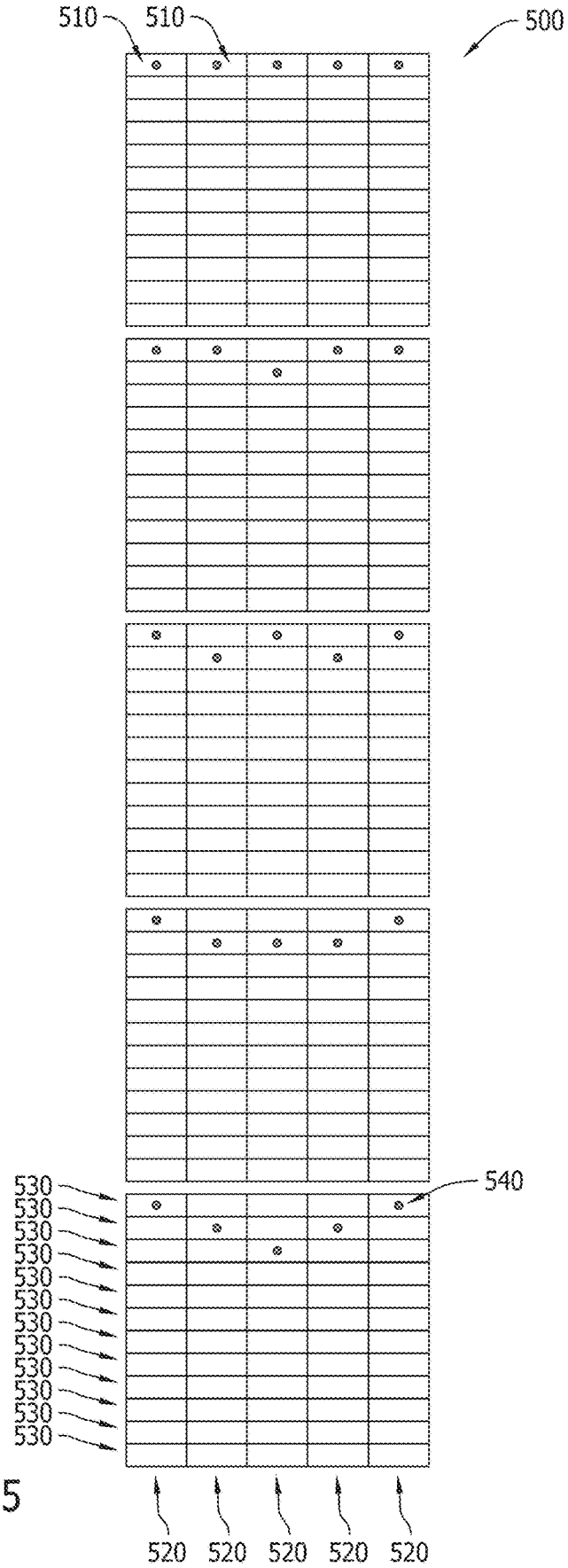

FIG. 5 shows schematic illustrations of a plurality of second play areas 500. In the example embodiment, each second play area 500 is a matrix including a plurality of second positions 510 arranged in a plurality of columns 520 and/or a plurality of rows 530. Although the illustrated second play areas 500 include five columns 520 and twelve rows 530, second play area 500 may have any configuration that that enables gaming machine 100 to function as described herein.

In the example embodiment, each column 520 represents and/or is associated with a reel. In the example embodiment, the reels are virtual. That is, in the example embodiment, the reels are generated by gaming machine 100 in memory prior to and/or during game play. Each second position 510 is associated with a respective symbol and may be modified or overwritten by gaming machine 100 during the course of gameplay. In this example, the game of chance uses a predetermined second set of symbols ("second symbol set") to populate second positions 510: "A", "K", "Q", "J", "10", and "W". The "W" symbol of these examples is a wild symbol, as further described herein and is circled merely for illustrative purposes. In some embodiments, the "W" symbol is a special symbol that may be treated as any one or more of the other symbols in the symbol set during award evaluation. It should be understood that the symbols used in this example symbol set are chosen merely for purposes of discussion. Any symbols may be used as symbol set, and any one or more of those symbols may be implemented as a wild symbol.

In the example embodiment, second play area 500 includes at least one second "payline" or pattern 540 including at least one second position 510. For example, in the example embodiment, each second pattern 540 includes a single (i.e., one and only one) second position 510 from each column 520. Moreover, in the example embodiment, second positions 510 within each second pattern 540 are serially connected (i.e., each second position 510 within second pattern 540 is in the same row 530 as a second position 510 within second pattern 540 in an adjacent column 520 or is in a row 530 immediately above or immediately below second position 510 within second pattern 540 in adjacent column 520). Alternatively, second pattern 540 may include any arrangement and/or combination of second patterns 540 that enable gaming machine 100 to function as described herein.

In the example embodiment, second pattern 540 satisfies a predetermined threshold (i.e., is a winning pattern) when second positions 510 within second pattern 540 are associated with symbols that satisfy a predetermined combination and/or arrangement of second positions 510 and/or symbols associated with second positions 510. For example, in the example embodiment, second pattern 540 is a winning pattern when a predetermined number (e.g., three) of second positions 510 within second pattern 540 are associated with a common symbol. In some embodiments, second pattern 540 is a winning pattern when a predetermined number (e.g., three) of serially-connected second positions 510 within second pattern 540 are associated with a common symbol. In at least some embodiments, second pattern 540 is a winning pattern when a predetermined number (e.g., three) of serially-connected second positions 510 within second pattern 540 are associated with a common symbol and one of the serially-connected second positions 510 is a second position 510 in the first (i.e., leftmost) column 520. Alternatively, any combination and/or arrangement second positions 510 and/or symbols associated with second positions 510 may satisfy the predetermined threshold that enables gaming machine 100 to function as described herein.

In some embodiments, second pattern 540 is a minor winning pattern when second pattern 540 satisfies a second predetermined threshold, and second pattern 540 is a major winning pattern when second pattern 540 satisfies a second predetermined threshold that is more difficult to satisfy than the second predetermined threshold. For example, in the example embodiment, second pattern 540 is a minor winning pattern when a second predetermined number (e.g., three) of second positions 510 within second pattern 540 are associated with a common symbol, and second pattern 540 is a major winning pattern when a second predetermined number (e.g., five) of second positions 510 within second pattern 540 are associated with a common symbol. Alternatively, any winning pattern may be associated with any combination and/or arrangement of second positions 510 and symbols associated with second positions 510 that enable gaming machine 100 to function as described herein.

Figure 6:
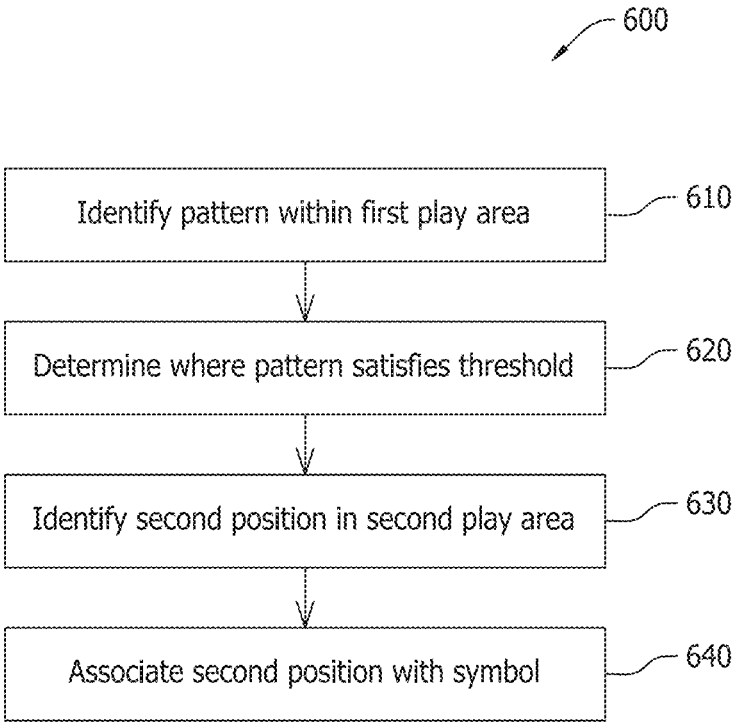

FIG. 6 is a flowchart of an example method 600 for presenting a game of chance on a gaming machine 100. In the example embodiment, method 600 is performed by a computing device including a processor and a memory, such as gaming controller 120 and/or gaming server 210. In some embodiments, one or more operations in method 600 may be performed by one or more gaming controllers 120, one or more gaming servers 210, and/or any other computing device or combination thereof.

In the example embodiment, method 600 includes receiving a play input from a player. In the example embodiment, a number of first patterns 440 and/or second patterns 540 are determined based on the play input. For example, in one embodiment, a first quantity of first patterns 440 and/or second patterns 540 are available and/or are considered in the game of chance when the play input is associated with a first bet (e.g., a single bet), and a second quantity of first patterns 440 and/or second patterns 540 greater than the first quantity are available and/or are considered in the game of chance when the play input is associated with a second bet (e.g., a maximum permitted wager).

In the example embodiment, columns 420 and/or 520 are "spun" by populating first positions 410 and/or second positions 510. In the example embodiment, at least one first pattern 440 within a first play area 400 is identified 610, and it is determined 620 whether first pattern 440 satisfies a predetermined first threshold. For example, in the example embodiment, it is determined 620 whether first pattern 440 is a winning pattern. First pattern 440 is evaluated, and an award and/or reward may be determined based on the determination 620. In at least some embodiments, it is determined whether the winning pattern is a major winning pattern or a minor winning pattern.

When first pattern 440 is determined 620 to be a winning pattern, at least one first symbol associated with a first position 410 within first pattern 440 is identified. More specifically, in the example embodiment, at least one first symbol that serves as a basis of determining 620 that first pattern 440 is a winning pattern is identified. For example, in the example embodiment, the first symbol associated with a predetermined number (e.g., three) of first positions 410 within first pattern 440 is identified. In some embodiments, the first symbol associated with a predetermined number (e.g., three) of serially-connected first positions 410 within first pattern 440 is identified. In at least some embodiments, the first symbol associated with a predetermined number (e.g., three) of serially-connected first positions 410 including a first position 410 in the first (i.e., leftmost) column 420 within first pattern 440 is identified. Alternatively, any first symbol may be identified based on any criteria that enables gaming machine 100 to function as described herein.

In the example embodiment, at least one second position 510 associated with the first symbol in second play area 500 is identified 630, and second position 510 associated with the first symbol is associated 640 with a second symbol. In some embodiments, the first symbol is replaced and/or repopulated by the second symbol. In other embodiments, the first symbol is supplemented by the second symbol. For example, in the example embodiment, the second symbol is a wild symbol.

In some embodiments, at least one second pattern 540 within second play area 500 is identified. As described above, the number of second patterns 540 may be based on the play input. Additionally or alternatively, the number of second patterns 540 may be based on a determination 620 of whether first pattern 440 satisfies a predetermined first threshold. For example, in one embodiment, a first quantity of second patterns 540 are available and/or are considered in the game of chance when first pattern 440 is determined 620 to be a minor winning pattern, and a second quantity of second patterns 540 greater than the first quantity are available and/or are considered in the game of chance first pattern 440 is determined 620 to be a major winning pattern.

In the example embodiment, it is determined whether second pattern 540 satisfies a predetermined second threshold. For example, in the example embodiment, it is determined whether second pattern 540 is a winning pattern. Second pattern 540 is evaluated using the first symbols and/or the second symbols, and an award and/or reward may be determined based on the determination. Accordingly, in the example embodiment, the warped symbols are used to potentially increase the awards and/or or rewards to the player. In at least some embodiments, it is determined whether the winning pattern is a major winning pattern or a minor winning pattern. Additionally or alternatively, a first award may be determined for satisfying the predetermined second threshold prior to associating the second position 510 with the second symbol, and a second award may be determined for satisfying the predetermined second threshold after associating the second position 510 with the second symbol.

One of ordinary skill in the art, guided by the teaching herein, will appreciate that one or more operations in method 600 may be performed repeatedly. For example, signals may be received repeatedly, and at least a portion of the steps described above may be performed based on each received signal.

FIGS. 7-10 are example schematic illustrations of the game of chance at various stages of method 600. In the example embodiment, first play area 400 includes five columns 420 and three rows 430, and second play area 500 includes five columns 520 and twelve rows 530.

A play of the game of chance, in some embodiments, includes a simulated spin of one or more of the reels. In the example embodiment, first play area 400 is populated by the first symbol set, and second play area 500 is populated by the second symbol set. In the example embodiment, at least one first pattern 440 within first play area 400 is identified, and it is determined whether first pattern 440 satisfies a predetermined first threshold.

As shown in FIG. 8, in the example embodiment, it is determined 620 that first pattern 440 is a winning pattern, and a first symbol "K" associated with a first position 410 within first pattern 440 is identified based on the first symbol "K" serving as a basis of determining that first pattern 440 is a winning pattern. The determination of first pattern 440 and/or identification of the first symbol "K" may be displayed in a time-delayed fashion and slow enough such that the player may witness or watch the determination and/or identification. For example, the simulated spin may occur between time t=0.0-1.0 seconds, the determination of first pattern 440 may occur between time 1.0-1.5 seconds, and the identification of the first symbol "K" may occur between time 1.5-2.0 seconds.

As shown in FIG. 9, in the example embodiment, each second position 510 associated with the first symbol "K" is identified. The identification of the first symbol "K" may be displayed in a time-delayed fashion and slow enough such that the player may witness or watch the identification. For example, the identification of the first symbol "K" may occur between time t=2.0-2.5 seconds.

As shown in FIG. 10, in the example embodiment, each second position 510 associated with the first symbol "K" is associated with a second symbol "W". The association of the second symbol "W" may be displayed in a time-delayed fashion and slow enough such that the player may witness or watch the identification and/or association. For example, the association of the second symbol "W" may occur between time 2.5-3.0 seconds.

As such, play experience for the player may be enhanced by the player based on the anticipation and/or realization that additional pay lines are possible. In some embodiments, the final outcome of the warping process is predetermined, or prescripted. For example, the gaming machine may determine an award and/or a game outcome and may determine a warping sequence that achieves this outcome. In other embodiments, the final outcome of the warping process may be selected from a set of potential outcomes. For example, a plurality of final results may be identified or generated, and one of these final results may be selected (e.g., randomly) from the plurality of final results.

The embodiments described herein facilitate increasing a probability of winning symbol combinations. The systems and methods described herein are not limited to the specific embodiments described herein but, rather, operations of the methods and/or components of the system and/or apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

A computer, controller, or server, such as those described herein, includes at least one processor or processing unit and a system memory. The computer, controller, or server typically has at least some form of computer readable media. By way of example and not limitation, computer readable media include computer storage media and communication media. Computer storage media include volatile and nonvolatile, removable and non-removable media implemented in any method or technology for storage of information such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art are familiar with the modulated data signal, which has one or more of its characteristics set or changed in such a manner as to encode information in the signal. Combinations of any of the above are also included within the scope of computer readable media.

Although the present disclosure is described in connection with an example gaming environment, embodiments of the present disclosure are operational with numerous other general purpose or special purpose communication environments or configurations. The gaming environment is not intended to suggest any limitation as to the scope of use or functionality of any aspect of the disclosure. Moreover, the gaming environment should not be interpreted as having any dependency or requirement relating to any one or combination of components illustrated in the example operating environment.

Embodiments of the present disclosure may be described in the general context of computer-executable instructions, such as program components or modules, executed by one or more computers or other devices. Aspects of the present disclosure may be implemented with any number and organization of components or modules. For example, aspects of the present disclosure are not limited to the specific computer-executable instructions or the specific components or modules illustrated in the figures and described herein. Alternative embodiments of the present disclosure may include different computer-executable instructions or components having more or less functionality than illustrated and described herein.

The order of execution or performance of the operations in the embodiments of the present disclosure illustrated and described herein is not essential, unless otherwise specified. That is, the operations may be performed in any order, unless otherwise specified, and embodiments of the present disclosure may include additional or fewer operations than those disclosed herein. For example, it is contemplated that executing or performing a particular operation before, contemporaneously with, or after another operation is within the scope of aspects of the present disclosure.

In some embodiments, the term "database" refers generally to any collection of data including hierarchical databases, relational databases, flat file databases, object-relational databases, object oriented databases, and any other structured collection of records or data that is stored in a computer system. The above examples are example only, and thus are not intended to limit in any way the definition and/or meaning of the term database. Examples of databases include, but are not limited to only including, Oracle® Database, MySQL, IBM® DB2, Microsoft® SQL Server, Sybase®, PostgreSQL, and SQLite. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

The present disclosure uses examples to disclose the best mode and also to enable any person skilled in the art to practice the claimed subject matter, including making and using any devices or systems and performing any incorporated methods. The patentable scope of the present disclosure is defined by the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A system comprising:

a display device;

an input interface; and a computing device comprising a processor and a memory storing instructions, which when executed by the processor, cause the processor, to at least:

in response to a receipt of an input via the input interface, display, on the display device, a first outcome comprising a plurality of symbols displayed at a plurality of first positions of a first play area, the displaying of the first outcome including displaying at least one first pattern that includes at least one first symbol in at least one first position of the plurality of first positions, the at least one first pattern satisfies a predetermined first threshold based on the at least one first position and the first symbol, wherein the predetermined first threshold comprises a winning combination of symbols;

display, on the display device, at least one second position that includes the first symbol in a second play area, the second play area including a plurality of second positions, the second play area separate from the first play area;

display, in response to the displaying of the at least one second position, a replacement of at least the first symbol included in the second position in the second play area with a second symbol; and display a second outcome of the second play area after replacing at least the first symbol included in the second position.

2. The system of claim 1, wherein the instructions further cause the processor to not replace the first symbol in the first position of the first play area with any other symbol.

3. The system of claim 1, wherein the second symbol is different from the first symbol.

4. The system of claim 1, wherein the at least one first pattern includes a plurality of serially connected first positions of the plurality of first positions.

5. The system of claim 1, wherein the second symbol that replaces the first symbol included in the second position in the separate second play area is a wild symbol.

6. The system of claim 1, wherein the winning combination of symbols of the predetermined first threshold further comprises at least three common symbols from the plurality of symbols.

7. The system of claim 1, wherein the instructions, further cause the processor to determine a number of second patterns, the number of second patterns, including the second symbol included in the second position, capable of comparison to a predetermined second threshold.

8. A method comprising:

in response to a receipt of an input via an input interface, displaying, on a display device, a first outcome comprising a plurality of symbols displayed at a plurality of first positions of a first play area the displaying of the first outcome including displaying at least one first pattern that includes at least one first symbol in at least one first position of the plurality of first positions, the at least one first pattern satisfies a predetermined first threshold based on the at least one first position and the first symbol, wherein the predetermined first threshold comprises a winning combination of symbols;

displaying, on the display device, at least one second position that includes the first symbol in a second play area, the second play area including a plurality of second positions, the second play area separate from the first play area;

displaying, in response to the displaying of the at least one second position, a replacement of at least the first symbol included in the second position in the second play area with a second symbol; and displaying a second outcome of the second play area after replacing at least the first symbol included in the second position.

9. The method of claim 8, wherein the at least one first pattern includes a plurality of serially connected first positions of the plurality of first positions.

10. The method of claim 8, wherein the second symbol that replaces the first symbol included in the second position in the separate second play area is a wild symbol.

11. The method of claim 8, wherein the winning combination of symbols of the predetermined first threshold further comprises at least three common symbols from the plurality of symbols.

12. The method of claim 8, further comprising:

identifying at least one second pattern within the second play area, the at least one second pattern including the second symbol in the second position; and determining whether the at least one second pattern, including the second symbol, satisfies a predetermined second threshold.

13. The method of claim 8, further comprising:

receiving, by the input interface, a play input; and determining a number of first patterns based on the play input.

14. The method of claim 8, further comprising:

receiving, by the input interface, a play input; and determining a number of second patterns based on the play input, the number of second patterns, including the second symbol included in the second position, capable of comparison to a predetermined second threshold.

15. One or more non-transitory computer-readable storage media having computer-executable instructions embodied thereon, wherein, when executed by at least one processor, the computer-executable instructions cause the at least one processor to at least:

in response to a receipt of an input via the input interface, cause to be displayed a first outcome comprising a plurality of symbols displayed at a plurality of first positions of a first play area, the displaying of the first outcome including at least one first pattern that includes at least one first symbol in at least one first position of the plurality of first positions, the at least one first pattern satisfies a predetermined first threshold based on the at least one first position and the first symbol, wherein the predetermined first threshold comprises a winning combination of symbols;

cause to be displayed at least one second position that includes the first symbol in a second play area, the second play area including a plurality of second positions, the second play area separate from the first play area;

cause to be displayed, in response to the displaying of the at least one second position, a replacement of at least the first symbol included in the second position in the second play area with a second symbol; and cause to be displayed a second outcome of the second play area after replacing at least the first symbol included in the second position.

16. The one or more non-transitory computer-readable storage media of claim 15, wherein the computer-executable instructions, when executed, further cause the at least one processor to not replace the first symbol in the first position of the first play area with any other symbol.

17. The one or more non-transitory computer-readable storage media of claim 15, wherein the winning combination of symbols of the predetermined first threshold further comprises at least three common symbols from the plurality of symbols.

18. The one or more non-transitory computer-readable storage media of claim 15, wherein the computer-executable instructions, when executed, further cause the at least one processor to:

identify at least one second pattern within the second play area, the at least one second pattern including the second symbol in the second position; and determine whether the at least one second pattern, including the second symbol, satisfies a predetermined second threshold.

19. The one or more non-transitory computer-readable storage media of claim 15, wherein the computer-executable instructions, when executed, further cause the at least one processor to:

receive a play input; and determine a number of first patterns based on the play input.

20. The one or more non-transitory computer-readable storage media of claim 15, wherein the computer-executable instructions, when executed, further cause the at least one processor to:

receive a play input; and determine a number of second patterns based on the play input, the number of second patterns, including the second symbol included in the second position, capable of comparison to a predetermined second threshold.

* * * * *